US012070092B2

(12) United States Patent
Kawamoto et al.

(10) Patent No.: US 12,070,092 B2
(45) Date of Patent: Aug. 27, 2024

(54) ASSEMBLY FOR ADDING FIBERS TO NATURAL EYELASHES AND CORRESPONDING COSMETIC TREATMENT METHOD

(71) Applicant: L'OREAL, Paris (FR)

(72) Inventors: Makoto Kawamoto, Kawasaki (JP); Shinsuke Okuda, Kawasaki (JP)

(73) Assignee: L'OREAL, Paris (FR)

( * ) Notice: Subject to any disclaimer, the term of this patent is extended or adjusted under 35 U.S.C. 154(b) by 429 days.

(21) Appl. No.: 16/626,704

(22) PCT Filed: Jun. 30, 2017

(86) PCT No.: PCT/JP2017/025062
§ 371 (c)(1),
(2) Date: Dec. 26, 2019

(87) PCT Pub. No.: WO2019/003454
PCT Pub. Date: Jan. 3, 2019

(65) Prior Publication Data
US 2020/0138138 A1 May 7, 2020

(51) Int. Cl.
*A41G 5/02* (2006.01)

(52) U.S. Cl.
CPC ..... *A41G 5/02* (2013.01)

(58) Field of Classification Search
CPC ..... A41G 5/02; A41G 5/008; A45D 2/48
USPC ..... 132/201, 216
See application file for complete search history.

(56) References Cited

U.S. PATENT DOCUMENTS

| | | | | |
|---|---|---|---|---|
| 2,667,176 | A | 1/1954 | Wassmer | |
| 3,691,140 | A * | 9/1972 | Spencer Ferguson Silver | C08F 220/1811 526/240 |
| 3,935,872 | A | 2/1976 | Aylott | |
| 4,018,336 | A | 4/1977 | Aylott | |
| 8,424,542 | B1 | 4/2013 | Han | |
| 9,215,901 | B1 | 12/2015 | Schroeder | |
| 2009/0217939 | A1 * | 9/2009 | Rabe | A41G 5/02 132/218 |

(Continued)

FOREIGN PATENT DOCUMENTS

| | | | |
|---|---|---|---|
| CN | 103717108 | A | 4/2014 |
| CN | 106793843 | A | 5/2017 |

(Continued)

OTHER PUBLICATIONS

FR2968520A1 (Barba Claudia; Samain Henri) (L'Oreal) Element Pour L'Application De Fibres Sur Des Fibres Keratiniques Humaines, Jun. 15, 2012. [retrieved on May 16, 2022], Translation retrieved from: Espacenet (Year: 2012).*

(Continued)

*Primary Examiner* — Cris L. Rodriguez
*Assistant Examiner* — Courtney N Huynh
(74) *Attorney, Agent, or Firm* — Oblon, McClelland, Maier & Neustadt, L.L.P.

(57) ABSTRACT

Assembly (5) for the cosmetic treatment for adding fibers to a fringe of natural eyelashes, comprising: —an adhesive composition (A) to be applied to the eyelashes, —at least one device (1) comprising a support (10), comprising at least one substrate (11; 11*a*, 11*b*), and fibers (12) having a first end portion (15) releasably borne by the support (10).

18 Claims, 2 Drawing Sheets

(56) References Cited

U.S. PATENT DOCUMENTS

| | | | | |
|---|---|---|---|---|
| 2009/0223534 | A1* | 9/2009 | Green | A41G 5/02 132/216 |
| 2014/0261514 | A1 | 9/2014 | Martins et al. | |
| 2014/0263392 | A1 | 9/2014 | Martins et al. | |
| 2015/0044410 | A1* | 2/2015 | Kim | A61Q 1/10 428/41.8 |
| 2015/0136162 | A1* | 5/2015 | Brouillet | A41G 5/02 132/286 |
| 2015/0201692 | A1 | 7/2015 | Hansen et al. | |
| 2015/0216246 | A1 | 8/2015 | Ahn et al. | |
| 2016/0264334 | A1* | 9/2016 | Sung | B65D 77/30 |
| 2017/0231309 | A1* | 8/2017 | Han | A41G 5/02 132/216 |
| 2022/0225750 | A1* | 7/2022 | Proctor | A41G 5/02 |

FOREIGN PATENT DOCUMENTS

| | | | | |
|---|---|---|---|---|
| FR | 2 968 520 | A1 | 6/2012 | |
| JP | 2015-59280 | A | 3/2015 | |
| JP | 2017-502823 | A | 1/2017 | |
| WO | WO-9823814 | A1 * | 6/1998 | D21C 5/005 |
| WO | WO 2004/055081 | A2 | 7/2004 | |
| WO | WO-2014110145 | A1 * | 7/2014 | A41G 5/02 |
| WO | WO 2015/091513 | A1 | 6/2015 | |
| WO | WO 2015/116247 | A1 | 8/2015 | |
| WO | WO 2016/153773 | A1 | 9/2016 | |
| WO | WO 2017/021240 | A1 | 2/2017 | |

OTHER PUBLICATIONS

Daitosol. Product property comparison [online]. May 12, 2015. [retrieved on Apr. 212, 2022] Retrieved from docplayer.net: <URL: https://docplayer.net/43279373-No-10-revised-12-may-2015-daito-kasei-kogyo-co-ltd.html> (Year: 2015).*

Daitosol. Product property comparison [online]. May 12, 2015. [retrieved on Apr. 21, 2022] Retrieved from docplayer.net: <URL:https://docplayer.net/43279373-No-10-revised-12-may-2015-daito-kasei-kogyo-co-ltd.html> (Year: 2015).*

U.S. Appl. No. 15/747,909, filed Jul. 26, 2016, Blanc, J.-B., et al.

U.S. Appl. No. 15/747,928, filed Jul. 26, 2016, Blanc, J.-B., et al.

Japanese Office Action issued Feb. 1, 2021 in Japanese Patent Application No. 2019-572237 (with English translation), 7 pages.

U.S. Appl. No. 16/626,741, filed Dec. 26, 2019, Shinsuke Okuda, et al.

International Search Report issued Mar. 23, 2018 in PCT/JP2017/025062 filed on Jun. 30, 2017.

Combined Chinese Office Action and Search Report issued on Dec. 2, 2020 in Chinese Patent Application No. 201780092773.9 (with English translation), 14 pages.

* cited by examiner

ASSEMBLY FOR ADDING FIBERS TO NATURAL EYELASHES AND CORRESPONDING COSMETIC TREATMENT METHOD

TECHNICAL FIELD

Field of the Invention

The present invention relates to assemblies for adding fake lashes to natural eyelashes and corresponding cosmetic treatment methods.

Background Art

Prior Art and Objectives of the Invention

For eyelash make-up, mascara is often used but the effect of lengthening and curling is not enough for some people. Mascara can usually give visible volume effect but can provide unnatural finish.

Eyelash extensions and false eyelashes are used for enhancing the length, thickness and fullness of natural eyelashes. Fake eyelash and eyelash extension become more popular due to the performances they provide for keeping a natural finish of the eyelashes.

Several methods of applying eyelash extensions may be carried out. The main method is individually adhering the fibers forming the extensions to the lash line one-by-one, thereby preventing the fibers from sticking to one another. Eyelash extensions may remain on for approximately three to four weeks.

False eyelashes are generally designed to be worn for a shorter period of one or two days. They are generally presented as a strip of fibers, which may be a full strip or a half strip or tufts of fibers. For applying the false eyelashes, the strip is glued on the roots of the eyelashes, after applying a glue either on the base of the strip or directly on the roots of the eyelashes.

However, known eyelash extensions and false eyelashes are not so convenient nor user-friendly to consumers. For instance, with conventional fake eyelash, it is time consuming or difficult to pick-up lashes from the packaging, put the glue on the root of fake lash, and very precisely put the root of lash on the edge of eyelid. After use, it is also difficult to remove the glue on the fake lashes for re-use. Sometimes, residual glues remain, which is not good in terms of hygiene. The application of glue on the skin (eyelid) is worse than on eyelash in terms of safety.

Furthermore, most of the glues that are used are cyanoacrylates, which is not good in terms of safety. In addition, the application of eyelash extensions needs to be made by a professional, at high cost and takes usually one to two hours. It lasts for almost one month, so that people cannot remove it when they want.

US 2016/0264334 provides a packaging for at least one false eyelash in which contact with the false eyelashes is minimized to maintain the quality, appearance and integrity of the false eyelashes.

DISCLOSURE OF INVENTION

A remaining problem is to benefit from visible performance such as the one provided by a false eyelash and eyelash extension in quicker and easier way while having good safety and hygiene.

There is a need to benefit from an assembly and a method for the cosmetic treatment of eyelashes by adding false eyelashes to natural eyelashes so as to provide perceivable volume, lengthening and/or curling effect to the natural eyelashes, said method being carried out rapidly, easily, safely, in good hygiene condition, and made oneself if possible.

[Assembly]

The present invention aims to meet this need and achieves this by, according to one of its aspects, an assembly for adding fibers to a fringe of natural eyelashes, comprising:

an adhesive composition to be applied to the eyelashes, at least one device comprising a support, comprising at least one substrate, and fibers having a first end portion releasably borne by the support.

The assembly according to the invention provides the possibility to create a false eyelash effect with a beautiful alignment of eyelashes and fibers, a visible lengthening and volume of eyelashes. Indeed, the at least one device is configured to be approached to the eyelashes of a person so that the fibers, especially a second end portion of the fibers, be brought into contact with the eyelashes, after application of the adhesive composition on the eyelashes. The support may then be removed so that at least part of the fibers remains on the eyelashes.

The first end portion of the fibers is preferably borne flat by the support.

At least one substrate of the support may be provided on a contact surface thereof with at least one bonding agent for bonding the fibers, preferably for bonding the first end portion of the fibers.

The support preferably comprises two substrates, in particular one bottom substrate and one upper substrate, the fibers being hold between said two substrates in a sandwich cross-sectional configuration.

At least one substrate of the device, preferably the bottom substrate, may have some hardness to put pushing forces in the fiber application by lifting up fibers. At least one of the substrates, preferably the bottom one, is transparent to allow the user to see the position of fibers to be attached. The bottom substrate may be made in a material that is sufficiently rigid not to bend significantly during use of the device to apply the fibers to the eyelashes. The bottom part may be thicker and/or wider in the direction to the second end of portion to support to lift up the fibers to the eyelashes.

The "bottom substrate" designates the part of the support which is under the "upper substrate" and the fibers when the device is used for applying the fibers.

At least one substrate of the device, in particular the bottom substrate, is preferably made of at least one polymer material, preferably a PET or PVC film.

At least one substrate, in particular the bottom substrate, is preferably at least partly made of a transparent material. "Transparent material" means a material that enables a user to see the fibers through the substrate, in particular in order to position of fibers to be attached.

At least one substrate, in particular the bottom substrate, may be made of a rigid material. The flexural rigidity of bottom substrate is preferably more than 0.1 mN·cm2/cm, more preferably 0.5 mN·cm2/cm, in terms of the average value of flexural rigidity in bending as measured with the Kawabata Evaluation System (KES).

The upper substrate and the bottom substrate are preferably made of different materials. The upper substrate may be made with an opaque material. The upper substrate may be made in a flexible material, and this material may be of a hardness that is less than that of the bottom substrate.

In one embodiment, the upper substrate and bottom substrate do not present the same shape. In particular, one part of the bottom substrate may be covered by the upper substrate, said part of the bottom substrate being the covered part, and another part of the bottom substrate may not be covered by the upper substrate, said another part of the bottom substrate being the uncovered part. The uncovered part may extend at least partly under a portion of the fibers, preferably a second end portion of the fibers, which is not bonded to the support. The uncovered part may present a free end having an outwardly concave shape. This outwardly concave shape may present a curvature substantially similar to the convex shape of the eyelid.

In another embodiment, the upper substrate and bottom substrate present the same dimensions and superpose exactly.

In one embodiment, the bottom substrate presents at least a flat surface in contact with the fibers and the upper substrate. The bottom substrate may be a flat substrate.

In another embodiment, at least the surface in contact with the fibers and upper substrate in the device is not flat but curved when at rest.

At least the upper substrate may be provided with a contact surface comprising at least one bonding agent. In this case, the contact surface of the upper substrate faces the fibers and the bottom substrate in the device and constitute an inner surface. The bottom substrate, in particular the surface in contact with the fibers and upper substrate in the device, may not comprise any bonding agent. The at least one bonding agent on the contact surface of the upper substrate may provide a removable fixation between the bottom substrate, the fibers and the upper substrate.

The support may comprise at least one gripping portion. The latter enables a user to grip and handle the support, in particular between the thumb and the index finger. The gripping portion may be made of a portion of the support that is not covered with the fibers or that do not hold fibers. The gripping portion of the support may comprise a part of the upper substrate and a part of the bottom substrate in contact with each other, said parts being substantially without any fibers between each other.

An "adhesive" composition denotes any material capable of withstanding being torn off, with or without a long-lasting adhesive strength.

Preferably, the fibers are arranged in at least one row on the support, and the fibers are preferably substantially parallel to one another.

The fibers are preferably bound by a link at a second end portion opposite to the first end portion. In such case, the fibers and link may constitute a false eyelash. The link may be a wire or a band. The fibers are advantageously connected by their first ends substantially perpendicularly to the link.

The fibers may be arranged as a strip of fibers or tufts of fibers.

The fibers in the at least one row of fibers may be curved such as a fringe of natural eyelashes. The at least one row may have a length substantially equal to the length of a fringe of eyelashes or may be shorter. Alternatively, the at least one row may form at least one tuft of fibers. The fibers may be regularly positioned within the at least one row or not. There may be several parallel rows of fibers, for example in order to provide the eyelash with a higher density of fibers.

By "substantially parallel" one should understand that the fibers may be parallel or present a small angle between one another such as in known false eyelashes.

The assembly may comprise a packaging for containing the adhesive composition and said at least one device, better at least two devices for treating two fringes of eyelashes. The at least one device is preferably totally removable from the packaging.

The present invention, according to another of its aspects, in combination with all or part of the above, also relates to an assembly for adding fibers to a fringe of natural eyelashes, comprising:

an adhesive composition to be applied to the eyelashes, at least one device comprising a support and fibers having a first end portion releasably borne by the support, the fibers being bound at a second end portion opposite to the first end portion by a link.

[Cosmetic Treatment Method]

The present invention also relates, according to another of its aspects, in combination with all or part of the above, to a cosmetic treatment method for adding fibers to a fringe of natural eyelashes, in particular using an assembly as defined above, comprising:

a) providing fibers having a first end portion releasably borne by a support comprising at least one substrate, in particular providing an assembly as defined above, b) applying an adhesive composition to at least part of the fringe of eyelashes, c) bringing a second end portion of the fibers, opposite the first end portion, into contact with said adhesive composition present on said fringe of eyelashes, d) moving the support away so as to release the fibers which adhere to said fringe of eyelashes.

The method according to the invention makes it possible to create a false eyelash effect with a beautiful alignment of eyelashes and fibers, a visible lengthening and volume of eyelashes.

The method may be implemented in a beauty center or at home.

The fibers may be applied on eyelashes in an easy gesture, in a time being less for example than 10 min, if not less than 1 min.

Furthermore, thanks to the releasable attachment to the support, there is no need to pick up the fibers by a tweezer or by the fingers. The support is actually different from a tweezer.

In one embodiment, the support comprises one substrate, the fibers being hold on a surface of the substrate, the fibers being preferably borne flat by the support, i.e. parallel to a contact surface thereof. In another embodiment, the support comprises two substrates, in particular one bottom substrate and one upper substrate, the fibers being hold between said two substrates in a sandwich cross-sectional configuration.

The adhesive composition may be applied in step b) on the eyelashes from the roots of the eyelashes over a length of the eyelashes, partially or in full range of eyelashes.

Step b) of applying an adhesive composition to at least part of the fringe of eyelashes is preferably implemented to the upper fringe of natural eyelashes on a lower side thereof, preferably at least near the roots of the eyelashes. During step c), the fibers may be brought into contact with the lower side of the upper fringe of the eyelashes.

Step c) may be carried out by bringing the fibers, especially the second end portion thereof, into contact with the lower part of the upper fringe of eyelashes, the link, if any, being substantially parallel to the arc defined by the root of the eyelashes of the eyelid.

Step b) is implemented by holding the support. Thus, during step c), the user holds the support for example with his fingers, between the thumb and the index finger. He does not need to use a tweezer for holding the fibers nor touch them.

The support advantageously comprises at least one substrate provided on a contact surface thereof with at least one bonding agent for bonding the fibers, preferably for bonding the first end portion of the fibers.

In a preferred particular embodiment, the support comprises two substrates, in particular a bottom substrate and an upper substrate, at least one, if not each of them, being provided on the contact surface with the at least one bonding agent, the fibers being held between the two substrates, preferably the first end portions of the fibers being bonded to the contact surface(s) of the substrate(s) via the at least one bonding agent. This may be a sandwich cross-sectional configuration, the fibers being hold between the two substrates.

When the support comprises at least one gripping portion, it may be transparent. The gripping portion preferably comprises a rigid sheet. The flexural rigidity of the gripping portion is preferably more than 0.1 mN·cm2/cm, more preferably 0.5 mN·cm2/cm, in terms of the average value of flexural rigidity in bending as measured with the Kawabata Evaluation System (KES). For the gripping portion, any kinds of materials and thickness may be used in the range of flexural rigidity above. When the gripping portion is a transparent rigid sheet, it enables the user to precisely position the fibers on the eyelashes. Indeed, the transparency of the gripping portion enables the user to have a clear view when implementing step c). The hardness of the gripping portion provides enough pushing force for transferring fibers quickly.

The support may be for a single use for the hygiene and also may be reusable. In reusable case, the substrates are strong/durable against the water and it may be preferably PET, PVC.

The first end portions of the fibers are preferably bonded flat against the support, especially against the contact surface of the substrate(s). In such case, the length of the fibers in contact with the contact surface of the substrate(s) may be comprised in the range 0.1 mm to 10 mm, better 0.5 mm to 7 mm, still better 0.5 mm to 3 mm. In one embodiment, the total length of the fibers is bonded to the support.

The holding force for holding the fibers on the support is preferably lower than the adhesive force for adhesion of the fibers to the adhesive composition applied to the eyelashes.

In particular, the adhesive force of the at least one bonding agent for holding the fibers on the support is advantageously lower than the adhesive force for adhesion of fibers to the adhesive composition applied to the eyelashes. The adhesive force for adhesion of the fibers to the adhesive composition is preferably at least double the adhesive force of the bonding agent for holding the fibers on the support.

The contact surface of at least one substrate is preferably substantially parallel to at least part of the fibers. It is noted that the fibers may be at least partly curved. In the latter case, the contact surface may also be at least partly curved.

One substrate may be releasably attached to the other. In step d), one substrate may be configured to be peeled away from the other by a pulling action.

The present invention also relates, according to another of its aspects, in combination with all or part of the above, to a cosmetic treatment method for adding fibers to a fringe of natural eyelashes, in particular using an assembly as defined above, comprising:

a) providing fibers having a first end portion releasably borne by a support, the fibers being bound by a link at a second end portion opposite to the first end portion, in particular providing an assembly as defined above, b) applying an adhesive composition to at least part of the fringe of eyelashes, c) bringing the second end portion of the fibers into contact with said adhesive composition present on said fringe of eyelashes, d) moving the support away so as to release the fibers which adhere to said fringe of eyelashes.

[Fibers]

The term "fiber" should be understood according to the invention as meaning an object of length L and of diameter D such that L is greater than D and preferably very much greater than D, D being the diameter of the circle in which the cross section of the fiber is inscribed. In particular, the ratio L/D (or aspect ratio) is chosen in the range from 3.5 to 2500, preferably from 10 to 1000 and better still from 20 to 500.

The fibers that can be used in the invention may be fibers of synthetic or natural, and mineral or organic, origin. They may be short or long, individual or organized, for example braided, and hollow or solid. They may have any shape, for example curved or straight. They may especially have a circular or polygonal (square, hexagonal or octagonal) cross section. In particular, their ends may be blunted and/or smoothed to prevent injury.

In particular, the fibers may have a length ranging from 2 mm to 20 mm.

Their cross section may range from 20 to 150 μm, 30 to 120 μm, even better still from 40 to 120 μm.

The weight or yarn count of the fibers is often given in denier or decitex and represents the weight in grams per 9 km of yarn. The fibers according to the invention have for example a yarn count chosen in the range from 0.1 to 100 denier, preferably from 1 to 70 denier and better still from 5 to 60 denier.

The fibers may be those used in the manufacture of textiles, and especially silk fibers, cotton fibers, wool fibers, flax fibers, cellulose fibers—especially extracted in particular from wood, from vegetables or from algae, rayon fibers, polyamide (Nylon®) fibers, viscose fibers, acetate fibers, especially rayon acetate fibers, acrylic polymer fibers, especially polymethyl methacrylate fibers or poly(2-hydroxyethyl methacrylate) fibers, polyolefin fibers and especially polyethylene or polypropylene fibers, polyethylene terephthalate (PET) fibers, polybutylene terephthalate (PBT) fibers, glass fibers, silica fibers, carbon fibers, especially fibers of carbon in graphite form, polytetrafluoroethylene (such as Teflon®) fibers, insoluble collagen fibers, polyester fibers, polyvinyl chloride fibers or polyvinylidene chloride fibers, polyvinyl alcohol fibers, polyacrylonitrile fibers, chitosan fibers, polyurethane fibers, polyethylene phthalate fibers, human hair or fibers formed from a mixture of polymers such as those mentioned above, for instance polyamide/polyester fibers.

The fibers may be human hair.

Furthermore, the fibers may be optionally surface-treated, optionally coated with a protective layer or a layer intended to give them a color.

Use may be made of flame-retardant acrylic fibers of "KANEKALON®" brand.

The fibers are for example those sold under the reference Minke-props SKINTEX® Flock ref. 590502.

It is possible to use identical fibers or as a variant a mixture of fibers that differ from one another in length, cross section, material, shape and/or cross section. The use of fibers of various lengths may impart greater naturalness. So may a mixture of colors. In a particular embodiment, the fibers borne by the support differ from one another in color. The colors of fibers may be mixed in an organized manner or randomly. This can create new aesthetic effects on the eyelashes.

[Link]

The link is used for bounding the fibers at the second end portions thereof, in one embodiment.

The link may be made of the same material as the one of the fibers.

The link may have a length equal to the length of the at least one row of fibers, if any.

The link may be colorless, transparent or may be black, white, or have a color such as yellow, red, blue, green, pink, violet or another color. The link may have the same or another color than the fibers or part of the fibers. For a natural finish, a transparent link is preferred.

The link may be fixed to the fibers, preferably to the second end of the fibers by an adhesive, or by weaving.

[Adhesive Composition]

The adhesive composition according to the invention is suitable for application to the eyelashes and eyelid, and for cosmetic use.

The adhesive composition comprises or is constituted of an adhesive material.

For the purposes of the present invention, the term "material" means a polymer or a polymeric system that may comprise one or more polymers of different natures. This adhesive material may be in the form of a polymer solution or a dispersion of polymer particles in a solvent. This adhesive material may in addition contain a plasticizer. This adhesive material must have a certain tackiness defined by its viscoelastic properties.

The adhesive material according to the invention may for example be chosen among pressure sensitive adhesives, for instance those cited in the "Handbook of Pressure Sensitive Adhesive Technology" $3^{rd}$ edition, D. Satas.

The adhesive material may be chosen among acrylic polymers or copolymers.

The pressure-sensitive adhesive materials may be chosen from acrylic polymers, especially copolymers of acrylate and methacrylate, pressure-sensitive adhesives based on rubber or based on styrene copolymers, for example such as styrene-isoprene-styrene (SIS) and styrene-butadiene-styrene (SBS) copolymers.

They may also be urethane polymers, polyurethanes, silicones, such as Bio-PSAs, ethylene/vinyl acetate polymers, block copolymers based on styrene or natural rubbers, chloroprene, butadiene, isoprene, neoprene or the like.

As nonlimiting examples of pressure-sensitive adhesives based on rubbery polymers, mention may in particular be made of natural rubber (poly(cis-1,4-isoprene)), methyl methacrylate-isoprene graft copolymers, styrene-butadiene copolymers, butyl rubber, acrylonitrile-butadiene rubber, styrene-isoprene block copolymers, polybutadiene, ethylene-butylene block copolymers and polychloroprene.

Among the pressure-sensitive adhesives comprising polar acrylic polymers, mention may be made of block or statistical copolymers based on acrylic acid, alkyl acrylates and alkyl methacrylates, and also the copolymers of these acrylics with ethylene and vinyl acetate.

An example of a pressure-sensitive adhesive that may be very partially suitable is poly(2-ethylhexyl acrylate), for example the one available commercially under the brand GEL-TAC® 100G (Advanced Polymer International), as an aqueous dispersion containing 40% solids of 15 micron adhesive acrylic microspheres.

Examples of acrylic copolymers that may be suitable are available commercially under the brands EASTAREZ 2010, 2020 and 2050 (Eastman Chemical Co.), ACRONAL® V210 BASF), MOWILITH LDM 7255, REVACRYL® 491 (Clariant) and FLEXBOND® 165 (Air Products). As other polymer which is preferred may be mentioned the DAITOSOL® 5500 GM from DAITO KASEI KOGYO which is an acrylates/ethylhexyl acrylate copolymer. The adhesive composition may for example be chosen among the adhesive composition for eyelashes called DUO®, commercialized by American International Industries, and the DAITOSOL® 5500 GM from DAITO KASEI KOGYO.

Commercial examples of polymeric rubbers that may be suitable are known under the brands RICON 130 polybutadiene (Atofina Sartomer) and ISOLENE® 40 polyisoprene Elementis).

Examples of polyurethane-based adhesives that may be suitable are available under the brands SANCURE® 2104 (Novéon) and VYLON UR 1400 (TOYOBO VYLON®).

Examples of vinyl acetate copolymers that may be suitable are available commercially under the brands PVP/VA 6-630 (International Specialty Products) and FLEXBOND 149 (Air Products).

Examples of vinyl alcohol/vinyl acetate copolymers are available commercially under the brands CELVOL 107 (Celanese) and ELVANOL® 50-42 (DUPONT®).

Mention may also be made of the block or statistical copolymers comprising at least one monomer or a combination of monomers whose resulting polymer has a glass transition temperature lower than ambient temperature)(25° C., these monomers or combinations of monomers possibly being chosen from butadiene, ethylene, propylene, isoprene, isobutylene, a silicone, and mixtures thereof. Examples of such materials are block polymers of the styrene-butadiene-styrene, styrene-(ethylene-butylene)-styrene or styrene-isoprene-styrene type, for instance those sold under the trade names "Kraton" from Kraton or "Vector" from DEXCO POLYMERS®.

The adhesive material according to the invention may also comprise tackifying resins, such as rosins or rosin derivatives such as hydrogenated rosins, rosin esters, hydrogenated rosin esters, terpenes, aliphatic or aromatic hydrocarbon-based resins, phenolic resins, styrene resins and coumarone-indene resins. Mention will also be made of the compounds such as shellac, sandarac gum, dammar resins, elemi gum, copal resins, benzoin, and gum mastic.

Mention may also be made of silicone resins, which are crosslinked polyorganosiloxane polymers.

The nomenclature of silicone resins is known under the name "MDTQ", the resin being described as a function of the various siloxane monomer units it comprises, each of the letters M, D, T and Q characterizing a type of unit.

Among these resins, mention may in particular be made of the siloxysilicate resins, which may be trimethyl siloxysilicates of formula $[(CH_3)_3XSiXO]_x(SiO_{4/2})_y$ (MQ units) in which x and y are integers ranging from 50 to 80, the lipodispersible film-forming polymers in the form of non-aqueous dispersions of polymer particles, also known as NADs Use may be made, as non-aqueous dispersion of hydrophobic film-forming polymer, of dispersions of particles of a grafted ethylenic polymer, preferably an acrylic polymer, in a liquid oily phase for example, in the form of surface-stabilized particles dispersed in the liquid fatty phase.

The dispersion of surface-stabilized polymer particles can be manufactured as described in the document WO 04/055081.

Mention may also be made of dispersions of $C_1$-$C_4$ alkyl (meth)acrylate polymer particles; stabilized by a stabilizing agent chosen from isobornyl (meth)acrylate polymers, as described in document WO 2015/091513.

Use may also be made of UV-reactive adhesives.

In examples, use is made of the PROS-AIDE® (acrylic latex) Cream Blend 331 Adhesive, or the AQ1350 Eastman Chemical (sulfopolyester soluble polymer) adhesive.

The adhesive composition can be applied as a continuous film on the eyelashes.

As a variant, the adhesive composition is applied by making non-adhesive areas between the adhesive areas, which offers control over the density and the distribution of the fibers that remain attached to the eyelashes.

Use may be made of an applicator that transfers the adhesive composition to the eyelashes.

The adhesive composition as described above is to be applied on the eyelashes. It may also form at least part of the contact surface of the substrate(s) of the support, if any. In such case, the adhesive force for adhesion of the fibers to the adhesive composition is preferably higher than, for example at least double the adhesive force of the adhesive composition for holding the fibers on the support. Still in this case, the adhesive composition of the contact surface of the substrate(s) and the adhesive composition for being applied to the eyelashes are chosen for respecting such prerequisite.

[Bonding Agent]

The bonding agent may be or comprise a pressure-sensitive material, for example as described above. The bonding agent is advantageously chosen so that the adhesive force of the at least one bonding agent for holding the fibers on the support is lower than the adhesive force for adhesion of fibers to the adhesive composition applied to the eyelashes. In such range of adhesive force, we may use any kinds of adhesives. In example, use is made of the acrylic polymers described in U.S. Pat. No. 3,691,140A, or SCOTCH® Color Stick Adhesive from SUMITOMO-3M. It may also be pressure-sensitive adhesives preferably.

BRIEF DESCRIPTION OF DRAWINGS

Brief Description of the Figures

Figure 1:
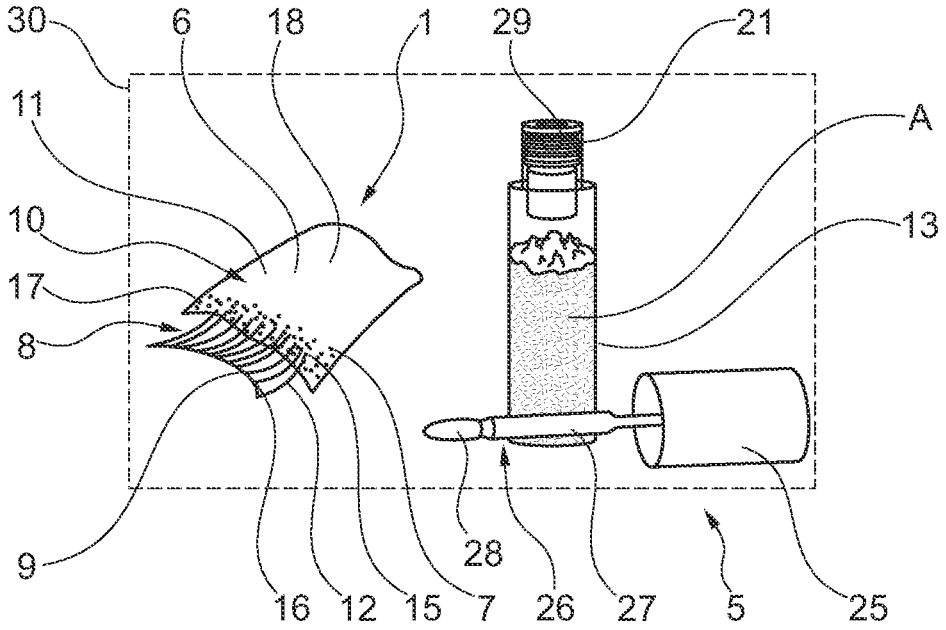
Figure 2:
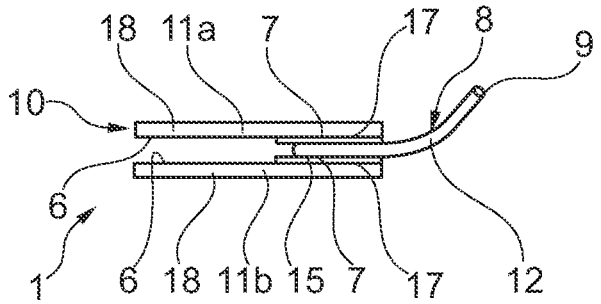
Figure 3:
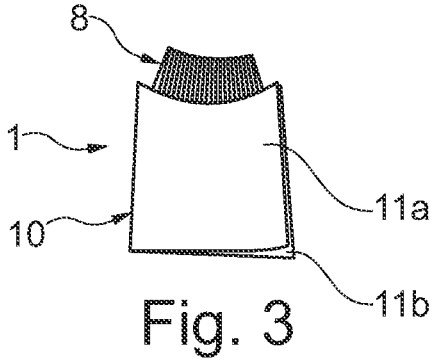
Figure 4:
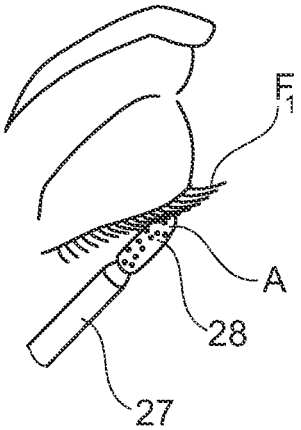
Figure 5:
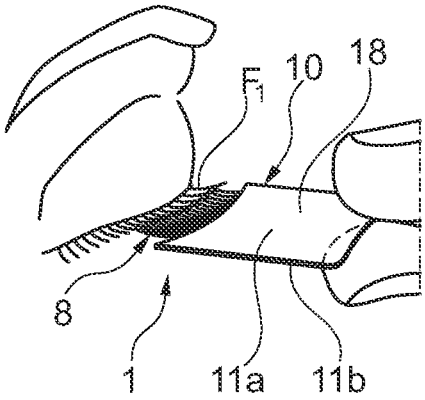
Figure 6:
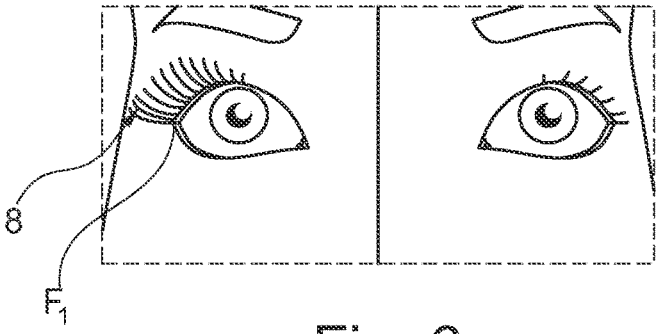
Figure 7:
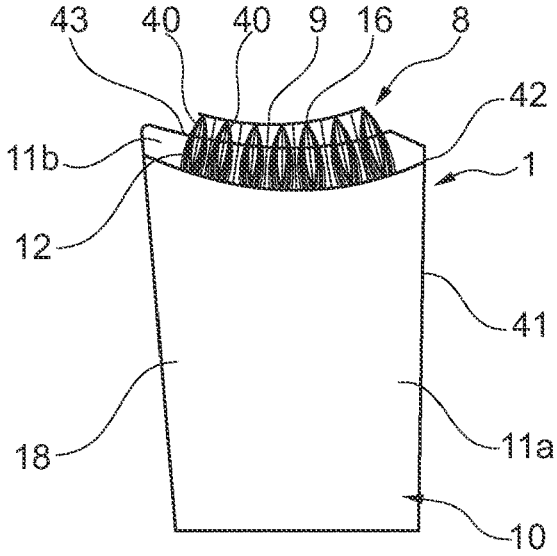
Figure 8:
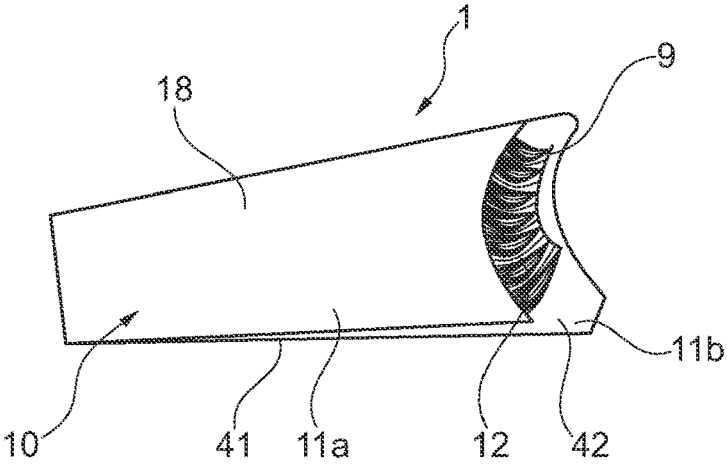

The invention may be better understood from reading the following detailed description of non-limiting exemplary embodiments thereof and from examining the appended drawing, in which:

FIG. 1 shows schematically an example of an assembly according to the present invention, FIG. 2 shows schematically in cross section an example of a device of an assembly according to the invention, FIG. 3 shows schematically and in perspective the device of FIG. 2, FIG. 4 is a schematic view of natural eyelashes during the implementation of one step of the method according to the invention, FIG. 5 is a similar view than FIG. 4 during the implementation of another step of the method according to the invention, FIG. 6 is a photograph of both eyes of a person for showing comparative examples of an eye after implementing the method according to the invention whereas the other eye has not been treated, FIG. 7 is a schematic top view of another example of a device of an assembly according to the invention, and FIG. 8 is a schematic view in perspective of the device of FIG. 7.

BEST MODE FOR CARRYING OUT THE INVENTION

Detailed Description of Embodiments

The cosmetic treatment method according to the invention may be implemented with the aid of an assembly 5, also called "kit", according to the invention and shown in FIG. 1.

The assembly 5 comprises an adhesive composition A contained in a container 13 and at least one device 1 comprising a false eyelash 8 borne by a support 10. The false eyelash 8 comprises in this example fibers 12, which are arranged in a row, and, in this example, connected by a link 9. Each fiber 12 has a first end portion 15 and a second end portion 16, the fibers 12 being bound in the second end portion 16 by the link 9, which is a wire in this example. The first end portion 15 of the fibers 12 is retained by the support 10.

In the example of FIG. 1, the support 10 comprises a substrate 11 formed by at least one fibrous material such as a paper provided in at least one zone 7 of the contact surface 6 thereof with a bonding agent 17 for releasably bonding the false eyelash 8. The at least one zone 7 forms a bonding surface. The bonding agent 17 has a weaker adhesive power than the adhesive composition A.

In the example shown, the bonding agent 17 comprises a pressure-sensitive material.

The support 10 is also provided with a gripping portion 18, which may have other shapes than shown. The fibers 12, which are arranged in a row in this example, are bonded to the support 10 at their first end portion 15, the contact surface 6 of the substrate being substantially parallel to the fibers. The fibers 12 are bonded flat against the substrate, i.e. parallel thereto. Only the first end portion 15 of the fibers 12 having a length of about 3 mm to 5 mm, in this example, is bonded to the substrate 11.

The container 13 comprises a threaded neck 21 and a cap 25 for closing the container 13 by cooperating with the threaded neck 21, the cap 25 supporting an adhesive applicator 26. The adhesive applicator 26 comprises a shaft 27 and an application element 28 at a free end. A wiping element 29 fits, in this example, to the interior side of the neck 21. The application element 28 may be a flocked support. It is loaded with the adhesive composition A in the container 13 before passing through the wiping element 29 for being used for example in the method according to the invention. The application element 28 is, in another embodiment, not shown, a brush similar to a mascara brush, for example.

The adhesive composition A may for example be chosen among the adhesive composition for eyelashes called DUO®, commercialized by American International Industries, and the Daitosol® 5500 GM from DAITO KASEI KOGYO. Another convenient adhesive composition may also be used.

The assembly 5 is, in this example, contained in a same packaging 30 as shown in FIG. 1 in dotted line. In the packaging 30, there may be one or several devices 1, especially two devices 1 (only one shown in FIG. 1) for both eyelashes.

As in the example shown in FIG. 2, the fibers 12 are hold at their first end portions 15 between two substrates 11*a* and 11*b* which are covered partly, in the zones 7 of the contact surfaces 6, with the bonding agent 17. In this example, the support 10 comprises an upper substrate 11*a* and a bottom substrate 11*b*. The substrates 11*a* et 11*b* are similar in shape and material in this example. They are formed by at least one fibrous material such as paper. They overlap perfectly. This device 1 comprising the support 10 and the false eyelash 8 is also shown in FIG. 3, ready to be used according to the method of the invention.

The first step of the method is to provide the device 1, i.e. the fibers 12 and link 9, forming the false eyelash 8, and the support 10, as shown in FIG. 3.

The second step of the cosmetic treatment method according to the invention is shown in FIG. 4 and consists in applying the adhesive composition A to at least part of a fringe F1 of natural eyelashes. The application element 28 loaded with adhesive composition A is applied to the upper fringe $F_1$ of natural eyelashes on the lower side thereof, at least near the roots of the eyelashes, as shown.

Then, as shown in FIG. 5, the next step of the method consists in bringing the fibers 12 into contact with the adhesive composition A present on the natural eyelashes. During this step, the second end portion 16 of the fibers 12 and the link 9 are brought into contact with the lower side of the upper fringe $F_1$ of the eyelashes. In this step, the whole device 1, with the fibers 12, link 9 and support 10, is removed from the packaging 30 and brought near the eye. The user holds the support 10 between two of his fingers, in the gripping portion 18, for example between the thumb and the index finger as shown in FIG. 5.

In a next step, the support 10 is moved away from the fibers 12 so as to release the fibers 12 which adhere to said fringe $F_1$ of natural eyelashes. The adhesive force for holding the fibers 12 on the support 10 is lower than the adhesive force for adhesion of the fibers 12 to the adhesive composition A applied to the eyelashes.

Before removing the support 10, the device 1 may be maintained in contact with adhesive composition A present on the eyelashes for several seconds or several minutes, for example between one to ten minutes.

For removing the support 10, the upper substrate 11*a* and the bottom substrate 11*b* are successively removed from the fibers 12. The upper substrate 11*a* may be removed firstly or secondly. One substrate, in this example the upper substrate 11*a*, is releasably attached to the other, in this example the bottom substrate 11*b*. One substrate, in this example the upper substrate 11*a*, is configured to be peeled away from the other, in this example the bottom substrate 11*b*, by a pulling action.

The support 10, once removed, is not reusable and is thrown away, in this example.

The result is shown in FIG. 6 on a person. In this photograph, the eye on the left is provided with the fibers 12 whereas the eye on the right is untreated (comparative examples).

The embodiment of FIGS. 7 and 8 shows another example of the device 1. In this example, the support 10 also comprises an upper substrate 11*a* and a bottom substrate 11*b*. They form a sandwich cross-sectional support for the fibers 12, as in FIGS. 2 and 3.

In this example, the fibers 12 are arranged as a row of tufts 40, each tuft 40 comprising several fibers 12.

In this example, the bottom substrate 11*b* is made with a polymer transparent film, in this example a PET film. The bottom substrate 11*b* thus provides visibility of full fibers to the user, during the implementation of the method. The bottom substrate 11*b* is also a substantially rigid sheet, which provides enough pushing force for transferring fibers quickly from the substrate to the eyelash.

Still in this example, only the upper substrate 11*a* is provided with the contact surface 6, in contact with the fibers 12 and an inner surface of the bottom substrate 11*b*. The bonding agent 17 enables to detach the first end portion 15 of the fibers 12 from the upper substrate 11*a* and the bottom substrate 11*b*.

In this embodiment, the upper substrate 11*a* and bottom substrate 11*b* do not present the same shape. A covered part 41 of the bottom substrate 11*b* is covered by the upper substrate 11*a*. An uncovered part 42 of the bottom substrate 11*b* is not covered by the upper substrate 11*a*. The uncovered part 42 extends partly under the second end portion 16 of the fibers, which is not bonded to the support 10. The uncovered part 42 presents in this example a free end 43 having an outwardly concave shape. This outwardly concave shape presents a curvature substantially similar to the convex shape of the eyelid.

The invention is not limited to the shown embodiments.

In a variant of the invention, the container 13 containing the adhesive composition A may be any container such as a tube, a bottle, a pressurized receptacle, a coated support, a pump-dispenser bottle or pot, this list not being limited.

There may be fibers 12 of different colors, shapes, materials, lengths, within a same false eyelash 8. There may be several rows of fibers 12 borne by the support 10.

The false eyelash 8 may comprise a tuft of fibers 12, or several tufts of fibers borne by one or several substrates. The false eyelash may have a shorter length than the fringe of eyelashes.

In one embodiment, the support 10 may not be thrown after a first use. In such case, the support 10 may be used after removal of the fibers 12 from the fringe of eyelashes in order to hold the fibers 12 again. Then this device 1 may be placed in the packaging 30, for example, before another use thereof.

The invention claimed is:

1. An assembly for a cosmetic treatment for adding fibers to a fringe of natural eyelashes, the assembly comprising:

an adhesive composition configured to be applied to the eyelashes, and at least one device comprising:

a support comprising at least one substrate, the at least one substrate being provided on a contact surface with at least one bonding agent, fibers configured to be applied to a fringe of natural eyelashes, during application of the fibers to the fringe of the natural eyelashes each fiber of the device having:

a first tip, a second tip, different from the first tip and opposite from the first tip, a first end portion extending from and including the first tip and being entirely releasably bonded to the at least one substrate by the at least one bonding agent, and a second end portion extending from and including the second tip and being entirely free, opposite the first end portion, said second end portion to be brought into contact with said adhesive composition present on said eyelashes.

2. The assembly according to claim 1, wherein the at least one substrate comprises two substrates, the fibers being held between said two substrates in a sandwich cross-sectional configuration.

3. The assembly according to claim 1, wherein the at least one substrate is made of at least one polymer material selected from a PET film and a PVC film.

4. The assembly according to claim 1, wherein the at least one substrate is made of a transparent material.

5. The assembly according to claim 1, wherein the at least one substrate is made of a rigid material, wherein a flexural rigidity is more than 0.1 mN·cm2/cm in terms of an average value of flexural rigidity in bending as measured with a Kawabata Evaluation System.

6. The assembly according to claim 1, wherein the fibers, which can be arranged in at least one row on the support, are substantially parallel to one another.

7. The assembly according to claim 1, wherein the fibers are bound by a link at the second end portion.

8. The assembly according to claim 1, wherein the adhesive composition comprises or is constituted of an adhesive material chosen among pressure sensitive adhesives.

9. The assembly according to claim 1, wherein the adhesive composition comprises or is constituted of an adhesive material chosen among acrylic polymers or copolymers.

10. The assembly according to claim 1, wherein the adhesive composition comprises an acrylates/ethylhexyl acrylate copolymer.

11. A cosmetic treatment method for adding fibers to a fringe of natural eyelashes, with an assembly according to claim 1, comprising:

a) providing the fibers having the first end portion releasably borne by the support comprising the at least one substrate, b) applying the adhesive composition to at least part of a fringe of eyelashes, c) bringing the second end portion of the fibers, opposite the first end portion, into contact with said adhesive composition present on said fringe of eyelashes, d) moving the support away so as to release the fibers which adhere to said fringe of eyelashes.

12. The method according to claim 11, wherein the support comprises two substrates, the fibers being held between said two substrates in a sandwich cross-sectional configuration.

13. The method according to claim 11, wherein applying the adhesive composition to the at least part of the fringe of eyelashes is implemented to an upper fringe of eyelashes on a lower side thereof, at least near roots of the eyelashes.

14. The method according to claim 11, wherein, during c), the fibers are brought into contact with a lower side of an upper fringe of the eyelashes.

15. The method according to claim 11, wherein the at least one substrate is provided on a contact surface thereof with at least one bonding agent for bonding the fibers.

16. The method according to claim 15, wherein the contact surface of the at least one substrate is substantially parallel to at least part of the fibers.

17. The method according to claim 11, wherein a holding force for holding the fibers on the support is lower than an adhesive force for adhesion of the fibers to the adhesive composition applied to the eyelashes.

18. The method according to claim 11, wherein the support comprises two substrates, one substrate being releasably attached to the other and, in d), one substrate being configured to be peeled away from the other by a pulling action.

* * * * *